US005673519A

United States Patent [19]

McCaughan

[11] Patent Number: 5,673,519

[45] Date of Patent: Oct. 7, 1997

[54] DOWNSPOUT EXTENSION DEVICE

[76] Inventor: Brian McCaughan, 157 McRae St., Okotoks, Alberta, Canada, TOL 1T3

[21] Appl. No.: 550,758

[22] Filed: Oct. 31, 1995

[51] Int. Cl.[6] ..... E04D 13/08

[52] U.S. Cl. ..... 52/16; 52/11; 137/579

[58] Field of Search ..... 52/16, 11; 137/579, 137/44, 615, 357, 873, 561 A; 251/72

[56] References Cited

U.S. PATENT DOCUMENTS

| | | | |
|---|---|---|---|
| 375,948 | 1/1888 | Pocknell | 251/72 |
| 2,567,004 | 9/1951 | Benck | 137/9 |
| 3,060,952 | 10/1962 | Bystrom | 52/16 X |
| 3,316,928 | 5/1967 | Weakley | 137/119 |
| 3,375,851 | 4/1968 | Henry et al. | 137/396 |
| 3,911,954 | 10/1975 | Johnson | 137/615 |
| 4,135,540 | 1/1979 | Felsen | 137/615 X |
| 5,014,745 | 5/1991 | Watt | 52/16 X |

*Primary Examiner*—Christopher Todd Kent
*Attorney, Agent, or Firm*—David S. Thompson

[57] ABSTRACT

Without a downspout extension rain water collected on the roof of a building is spilled onto the ground beside the foundation. This causes damp and musty basements and sometimes even cracked foundations. The problem with using a downspout extension is that it must be walked over; additionally it must be removed and re-installed in order to cut a lawn thereunder. The automatic extension device disclosed utilizes a rocker arm having a cup on one end and a latch/hook on the other. An upright tubular member having an upper end portion adapted to slide over the downspout and a lower end portion which elbows outwardly away from an adjacent building wall has an extension tube pivotably connected thereto. A channel extending laterally and downwardly from inside the upright tubular member to above the cup diverts rain water from the downspout into the cup. The extension tube is stored in an upright position having one end held up by the latch/hook. At the onset of a rain storm the cup is filled, and the rocker arm rotates lifting up the latch/hook; this causes the extension to automatically fall into an operable position. The extension may be rotatably lifted for lawn maintenance into its storeage position where it is maintained by the latch/hook.

7 Claims, 1 Drawing Sheet

DOWNSPOUT EXTENSION DEVICE

FIELD OF THE INVENTION

This invention relates to rain gutters and downspouts on residential homes, and more particularly to extension devices which automatically extend from a storage position when needed and which can be readily repositioned to the storage position after use.

BACKGROUND OF THE INVENTION

Downspouts are used to conduct rain water collected in rain gutters on roofs downwardly to the ground. They typically spill all the water collected on the roof at a point alongside the foundation of the building. In a heavy downpour or during a period of prolonged rain this results in flooding and potential seepage through the foundation into the basement of the building. If the ground freezes after the foundation is saturated with water, cracking of the foundation can result. More typically a damp and musty smelling basement is the result.

One solution to this problem is to extend the downspout outwardly away from the building so that the water is spilled away from the foundation of the building. The problem with this approach is that typically the building is surrounded by a manicured lawn which must be maintained.

OBJECTS AND STATEMENT OF THE INVENTION

It is an object of this invention to disclose a downspout extension which may be readily lifted from an in use position to a storage position which is off the ground thereby eliminating a tripping hazard and enabling lawn mowing and other ground maintenance. It is a further object of this invention to disclose a downspout extension device which will automatically move from the storage position to an operable position when required at the onset of a rain storm. It is a final object of this invention to disclose a downspout extension device which can be easily and quickly installed by almost any home owner with commonplace tools.

One aspect of this invention provides for an automatic downspout extension device to conduct rain water received from a downspout, away from an adjacent building wall before spilling onto a ground surface comprising: an upright tubular member having an upper end portion adapted to slide over the downspout and a lower end portion which elbows outwardly away from the adjacent building wall; a rocker arm having a mid portion pivotably connected to an upper portion of the upright tubular member, a cup carried by its wall end portion, and a latch/hook extending downwardly from its other end portion; an extension tube having one end pivotably connected to the lower end portion of the upright tubular member and the other end rotatable between an upright storage position where it can be maintained by the latch/hook, and an operable position where it rests on the ground; whereby in use the extension tube may be held in the upright storage position by the latch/hook on the rocker arm until a rainfall when rain water in the downspout fills the cup causing the rocker arm to rotate and lift the latch/hook which in turn causes the extension tube to fall to the ground.

A preferred aspect of this invention provides for a device as above but where the rocker arm is positioned outside the downspout and a channel extending laterally and downwardly from inside the upright tubular member to above the cup diverts rain water into the cup. A bucket attached to a mid portion of the upright tubular member beneath the cup catches water spilling from the cup. The bucket has a drain in its bottom portion draining water collected in the bucket into the mid portion of the upper upright tubular member. As above when the cup is filled it rotates downwardly lifting the latch/hook and dropping the extension tube into an operable position. Water diverted from the downspout by the channel is collected in the bucket and then drains back into the upright tubular member.

Various other objects, advantages and features of this invention will become apparent to those skilled in the art from the accompanying drawings.

FIGURES OF THE INVENTION

Figure 1:
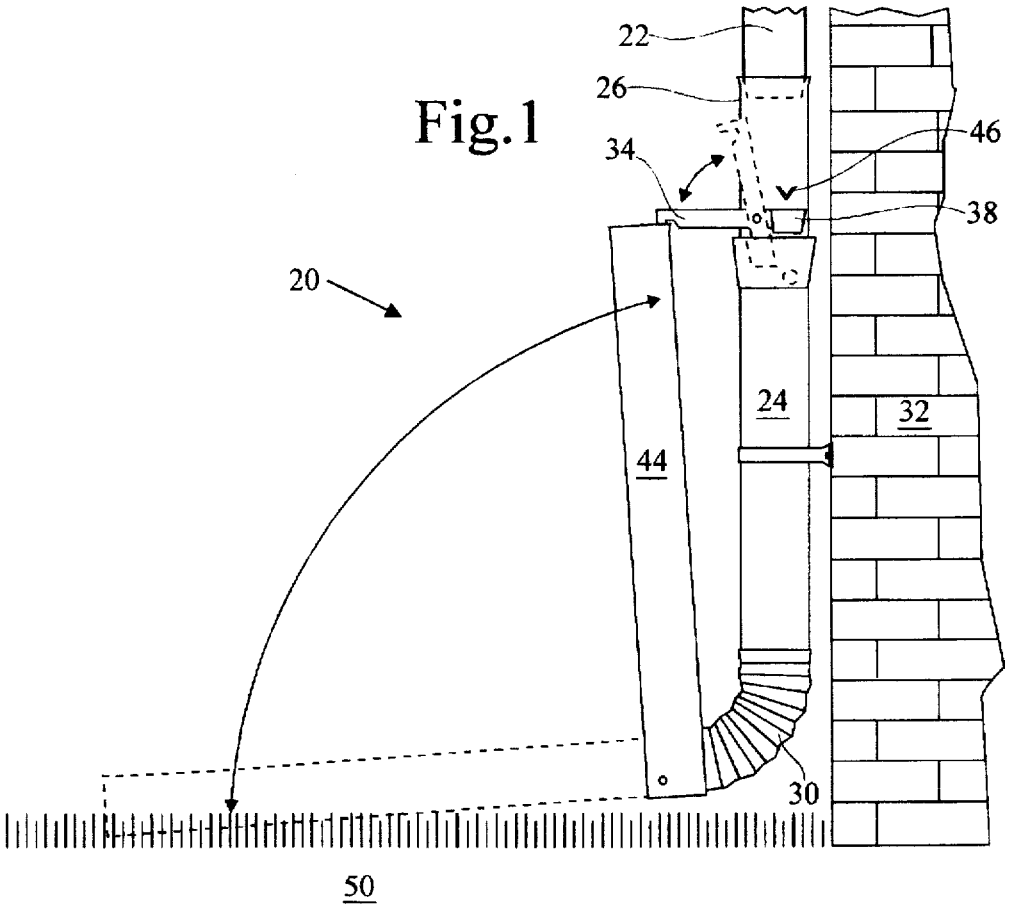
FIG. 1 is an elevational view of the Downspout Extension Device.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have an elevation view of a Downspout Extension Device 20 slid over a downspout 22. An upright tubular member 24 has an upper end portion 26 which slides over the downspout 22 and a lower end portion 30 which elbows outwardly away from an adjacent building wall 32.

Figure 2:
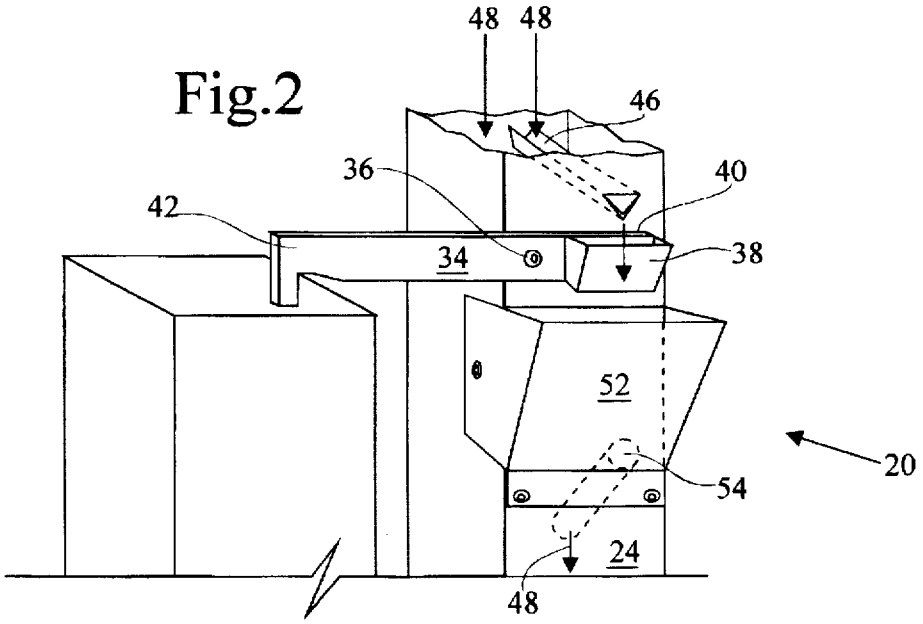
FIG. 2 is an enlarged perspective view of a top portion of the Downspout Extension Device shown in FIG. 1.

FIG. 2 is an enlarged perspective view of at top portion of the Downspout Extension Device 20 shown in FIG. 1. A rocker arm 34 having a cup 38 carried by the wall end portion 40 of the rocker arm 34, and a latch/hook 42 extending downwardly from its other end portion has a mid portion pivotably fastened, preferably by a rivet 36 to an upper portion 26 of the tubular member 24.

Looking again at FIG. 1 we see an extension tube 44 having one end pivotably connected to the lower end portion 30 half of the upright tubular member 24 and the other end rotatable between an upright storage position where it can be maintained by the latch/hook 42 and an operable position (shown in ghost) where it rests on a ground surface 50.

In one aspect of the invention (not shown)the rocker arm 34 is positioned and pivots inside the upright tubular member 24; only its latch/hook 42 is outside of the tubular member 24. However, in the preferred aspect of the invention, as shown in the drawings, the entirety of the rocker arm 34 is outside the upright tubular member 24 and a channel 46 extending laterally and downwardly from inside the upright tubular member 24 to above the cup 38 diverts rain water 48 into the cup 38. When the cup 38 is filled with rain water 48 the rocker arm 34 rotates lifting the latch/hook 42 causing the extension tube 44 to fall to the ground surface 50.

Most preferbly a bucket 52 is attached to a mid portion of the upright tubular member 24 beneath the cup 38. A bottom portion of the bucket 52 has a drain which preferably is a drain tube 54 which drains through the adjacent sidewall of the upright tubular member 24. The drain tube 54 extends downwardly into the upright tubular member 24 so that rain water 48 collected in the bucket 52 drains into the upright tubular member 24.

In the preferred embodiment the channel 46 has been made from a short length of angle iron. The rocker arm 34 has similarly been made from steel, having its cup 38, made from sheet metal. The bucket 52 has also been fabricated from sheet steel and the drain tube 54 sealingly soldered therein. The channel 46 is held and positioned in the upright tubular member 24 by wedging it into cutouts on opposite sides of the upright tubular member 24. The drain tube 24 also penetrates into the upright tubular member 24 through a cutout. Both the rocker arm 34, and the bucket 52 are fastened to the upright tubular member 24 by rivets 36 as shown in FIG. 2. It is contemplated that both the rocker arm 34, which may have an integrally formed cup 38, and the bucket 52, having an integral drain pipe 54, could be more economically fabricated from molded plastic in higher volume applications.

While the invention has been described with preferred specific embodiments thereof, it will be understood that this description is intended to illustrate and not to limit the scope of the invention, which is defined by the following claims.

I claim:

1. An automatic downspout extension device to conduct rain water received from a downspout away from an adjacent building wall before spilling onto a ground surface comprising:

an upright tubular member having an upper end portion adapted to slide over the downspout and a lower end portion;

a rocker arm having a mid portion pivotably connected to an upper portion of the upright tubular member, a wall end portion carrying a cup, and another end portion having a latch/hook extending downwardly therefrom;

an extension tube having one end pivotably connected to the lower end portion of the upright tubular member so that the extension tube may be rotated between an upright storage position where it can be maintained by the latch/hook, and an operable position where it rests on the ground surface;

whereby in use the extension tube may be held in the upright storage position by the latch/hook on the rocker arm until a rainfall when rain water in the downspout fills the cup causing the rocker arm to rotate and lift the latch/hook which in turn causes the extension tube to fall to the ground surface.

2. An automatic downspout extension device to conduct rain water received from a downspout away from an adjacent building Wall before spilling onto a ground surface comprising:

an upright tubular member having an upper end portion adapted to slide over the downspout and a lower end portion;

a rocker arm having a mid portion pivotably connected to an upper portion of the upright tubular member, the rocker arm positioned outside the upright tubular member, a wall end portion carrying a cup; and another end portion having a latch/hook extending downwardly therefrom;

an extension tube having one end pivotably connected to the lower end portion of the upright tubular member so that the extension tube may be rotated between an upright storage position where it can be maintained by the latch/hook, and an operable position where it rests on the ground surface;

whereby in use the extension tube may be held in the upright storage position by the latch/hook on the rocker arm until a rainfall when rain water in the downspout fills the cup causing the rocker arm to rotate and lift the latch/hook which in turn causes the extension tube to fall to the ground surface.

3. A device as in claim 2 further comprising a bucket attached to a mid portion of the upright tubular member beneath the cup and said bucket having a drain in (its) a bottom portion thereof draining into the mid portion of the upper upright tubular member, so that when the cup is filled and rotates downwardly lifting the latch/hook on the other end of the rocker arm, water diverted from the downspout by the channel is collected in the bucket and then drains back into the upright tubular member.

4. A device as in claim 3 wherein the drain comprises an opening in the lower side wall of the bucket adjacent to the upright tubular member.

5. A device as in claim 4 wherein the drain comprises a drain tube having one end extending through and sealingly connected to the sidewall of the bucket, and the other end in a lower portion of the bucket, so that water collected in the bucket drains into the upright tubular member.

6. A device as in claim 5 wherein the bucket and cup are fabricated from sheet metal.

7. A device as in claim 5 wherein the bucket has an integrally formed drain pipe, and the rocker arm has an integrally formed cup, and both the bucket and the rocker arm are molded from plastic.

* * * * *